US007551185B2

(12) United States Patent
Beuker et al.

(10) Patent No.: US 7,551,185 B2
(45) Date of Patent: Jun. 23, 2009

(54) APPARATUS FOR RE-ORDERING VIDEO DATA FOR DISPLAYS USING TWO TRANSPOSE STEPS AND STORAGE OF INTERMEDIATE PARTIALLY RE-ORDERED VIDEO DATA

(75) Inventors: Rob Anne Beuker, Best (NL); Teunis Poot, Geldrop (NL); Gerben Johan Hekstra, Waalre (NL)

(73) Assignee: NXP B.V., Eindhoven (NL)

( * ) Notice: Subject to any disclaimer, the term of this patent is extended or adjusted under 35 U.S.C. 154(b) by 293 days.

(21) Appl. No.: 10/540,103

(22) PCT Filed: Dec. 8, 2003

(86) PCT No.: PCT/IB03/05989

§ 371 (c)(1),
(2), (4) Date: Jun. 20, 2005

(87) PCT Pub. No.: WO2004/057560

PCT Pub. Date: Jul. 8, 2004

(65) Prior Publication Data

US 2006/0061600 A1 Mar. 23, 2006

Related U.S. Application Data

(60) Provisional application No. 60/435,104, filed on Dec. 20, 2002.

(51) Int. Cl.
*G09G 5/02* (2006.01)
*G09G 5/04* (2006.01)

(52) U.S. Cl. ..... 345/649; 345/600; 345/3.2

(58) Field of Classification Search ..... 345/3.2, 345/600, 649

See application file for complete search history.

(56) References Cited

U.S. PATENT DOCUMENTS

| | | | | |
|---|---|---|---|---|
| 4,400,726 | A * | 8/1983 | Van Hulle | 725/147 |
| 4,575,754 | A * | 3/1986 | Bar-Zohar | 380/215 |
| 4,989,092 | A * | 1/1991 | Doyle et al. | 348/448 |
| 5,048,104 | A * | 9/1991 | D'Aoust et al. | 382/293 |
| 5,329,319 | A * | 7/1994 | Sgrignoli | 348/733 |
| 5,432,557 | A * | 7/1995 | Hamann et al. | 375/240.01 |
| 5,485,554 | A * | 1/1996 | Lowitz et al. | 358/1.17 |
| 5,677,979 | A * | 10/1997 | Squicciarini et al. | 386/46 |
| 5,801,777 | A * | 9/1998 | Lyu | 375/240.15 |
| 5,818,419 | A * | 10/1998 | Tajima et al. | 345/691 |
| 5,822,490 | A * | 10/1998 | Strolle | 386/1 |
| 6,052,118 | A * | 4/2000 | Beeteson et al. | 345/207 |
| 6,061,040 | A | 5/2000 | Onodera et al. | |
| 6,148,140 | A * | 11/2000 | Okada et al. | 386/105 |
| 6,232,951 | B1 * | 5/2001 | Miyamoto | 345/698 |
| 6,269,482 | B1 * | 7/2001 | Gershfeld | 725/107 |

(Continued)

FOREIGN PATENT DOCUMENTS

EP 0 755 043 A1 1/1997

(Continued)

*Primary Examiner*—Javid A Amini

(57) ABSTRACT

A generic apparatus (14) re-orders video data for various types of displays, such as plasma discharge panels (PDPs), digital micro-mirror devices (DMDs), liquid crystal on silicon (LCOS) devices, and transpose scan cathode ray tube (CRT) displays. In one embodiment, the apparatus (14) includes a first programmable transpose processor (18), a memory (20, 120), and a second programmable transpose processor (22, 122) fabricated as a single IC unit.

27 Claims, 10 Drawing Sheets

U.S. PATENT DOCUMENTS

| | | | | |
|---|---|---|---|---|
| 6,304,604 | B1 * | 10/2001 | Adiletta et al. | 375/240.18 |
| 6,310,659 | B1 * | 10/2001 | Glen | 348/589 |
| 6,326,958 | B1 * | 12/2001 | Gorny et al. | 345/204 |
| 6,373,497 | B1 * | 4/2002 | McKnight et al. | 345/602 |
| 6,470,139 | B2 * | 10/2002 | Austin | 386/95 |
| 6,518,970 | B1 * | 2/2003 | Glen et al. | 345/501 |
| 6,525,742 | B2 * | 2/2003 | Nonomura et al. | 345/603 |
| 6,701,063 | B1 * | 3/2004 | Komoda et al. | 386/95 |
| 6,727,907 | B2 * | 4/2004 | Nonomura et al. | 345/603 |
| 6,798,458 | B1 * | 9/2004 | Unemura | 348/448 |
| 6,970,146 | B1 * | 11/2005 | Jun | 345/3.1 |
| 7,053,868 | B1 * | 5/2006 | Kojima et al. | 345/60 |
| 7,224,890 | B2 * | 5/2007 | Kato | 386/111 |
| 7,349,623 | B1 * | 3/2008 | Fujita et al. | 386/95 |
| 7,409,144 | B2 * | 8/2008 | McGrath et al. | 386/117 |
| 2001/0005233 | A1 * | 6/2001 | Nonomura et al. | 348/465 |
| 2001/0043799 | A1 * | 11/2001 | Okada et al. | 386/95 |
| 2002/0030691 | A1 * | 3/2002 | McKnight et al. | 345/602 |
| 2002/0041335 | A1 * | 4/2002 | Taraci et al. | 348/511 |
| 2002/0159526 | A1 * | 10/2002 | Hekstra | 375/240.15 |
| 2003/0011606 | A1 * | 1/2003 | Nonomura et al. | 345/547 |
| 2003/0071831 | A1 * | 4/2003 | Beuker et al. | 345/690 |
| 2004/0008206 | A1 * | 1/2004 | Tognoni et al. | 345/589 |

FOREIGN PATENT DOCUMENTS

| | | | |
|---|---|---|---|
| WO | WO 00/00959 | * | 1/2000 |
| WO | WO 00/70391 | | 11/2000 |
| WO | WO 00/70595 | | 11/2000 |
| WO | WO 00/70598 | | 11/2000 |

* cited by examiner

APPARATUS FOR RE-ORDERING VIDEO DATA FOR DISPLAYS USING TWO TRANSPOSE STEPS AND STORAGE OF INTERMEDIATE PARTIALLY RE-ORDERED VIDEO DATA

CROSS REFERENCE TO RELATED APPLICATION

This application claims the benefit of U.S. provisional application Ser. No. 60/435,104 filed Dec. 20, 2002, which is incorporated herein by reference.

The invention relates to integrated circuits for re-ordering video data for various types of displays. It finds particular application in conjunction with re-ordering video data for plasma discharge panels (PDPs), digital micro-mirror devices (DMDs), liquid crystal on silicon (LCOS) devices, and transpose scan cathode ray tube (CRT) displays and will be described with particular reference thereto. However, it is to be appreciated that the invention is also amenable to other types of display and other applications.

New types of displays and new display driving schemes for traditional displays (e.g., cathode ray tube (CRT) displays) are emerging with the advent of digital television (TV) and advancements in personal computer (PC) monitors. Examples of new displays include PDPs, DMDs, and LCOS devices. An example of a new driving scheme for a display is known as transposed scan. These new technologies rely on digital display processing and are typically implemented using a variety of interconnected, individual application specific integrated circuits (ASICs).

Traditional displays commonly operate using a raster scanning system. In a raster scanning system, displays scan video data in lines and repeat line scanning by advancing the scan line in a direction substantially perpendicular to the line direction. In a typical raster scan, the lines are scanned in a horizontal direction while the scan line is advanced in a vertical direction. Conversely, in devices using a transpose scan approach, the lines are scanned in the vertical direction and the scan line is advanced in the horizontal direction. Transpose scanning is known to improve raster and convergence (R & C) problems, landing problems, focussing uniformity, and deflection sensitivity in wide screen displays, Transposed scanning may be beneficial for other types of displays, such as matrix displays, as well as CRTs. Transposed scanning implies that the video signal must be transposed as well.

PDPs typically have wide screens, comparable to large CRTs, but they require much less depth (e.g., 6 in. (15 cm)) than CRTs. The basic idea of a PDP is to illuminate hundreds of thousands of tiny fluorescent lights. Each fluorescent light is a tiny plasma cell containing gas and phosphor material. The plasma cells are positioned between two plates of glass and arranged in a matrix. Each plasma cell corresponds to a binary pixel. Color is created by the application of red, green and blue columns. A PDP controller varies the intensities of each plasma cell by the amount of time each cell is on to produce different shades in an image. The plasma cells in a color PDP are made up of three individual sub-cells, each with different colored phosphors (e.g., red, green, and blue). As perceived by human viewers, these colors blend together to create an overall color for the pixel.

By varying pulses of current flowing through the different cells or sub-cells, the PDP controller can increase or decrease the intensity of each pixel or sub-pixel. For example, hundreds of different combinations of red, green, and blue can produce different colors across the overall color spectrum.

Similarly, by varying the intensity of pixels in a black and white monochrome PDP, various gray scales between black and white can be produced.

LCOS devices are based on LCD technology. But, in contrast to traditional LCDs, in which the crystals and electrodes are sandwiched between polarized glass plates, LCOS devices have the crystals coated over the surface of a silicon chip. The electronic circuits that drive the formation of the image are etched into the chip, which is coated with a reflective (e.g., aluminized) surface. The polarizers are located in the light path both before and after the light bounces off the chip. LCOS devices have high resolution because several million pixels can be etched onto one chip. While LCOS devices have been made for projection TVs and projection monitors, they can also be used for micro-displays used in near-eye applications like wearable computers and heads-up displays.

For an LCOS projector, the following steps are involved: a) a digital signal causes voltages on the chip to arrange in a given configuration to form the image, b) the light (red, green, blue) from the lamp goes through a polarizer, c) the light bounces off the surface of the LCOS chip, d) the reflected light goes through a second polarizer, e) the lens collects the light that went through the second polarizer, and f) the lens magnifies and focuses the image onto a screen. There are several possible configurations when using LCOS. A projector might shine three separate sources of light (e.g., red, green and blue) onto different LCOS chips. In another configuration, the LCOS device includes one chip and one source with a filter wheel. In another configuration, a color prism is used to separate the white light into color bars. In other configurations, the LCOS device might utilize some combination of these three options.

A DMD is a chip that has anywhere from 800 to more than one million tiny mirrors on it, depending on the size of the array. Each 16-$\mu m^2$ mirror ($\mu$m=millionth of a meter) on a DMD consists of three physical layers and two "air gap" layers. The air gap layers separate the three physical layers and allow the mirror to tilt +10 or −10 degrees. When a voltage is applied to either of the address electrodes, the mirrors can tilt +10 degrees or −10 degrees, representing "on" or "off" in a digital signal.

In a projector, light shines on the DMD. Light hitting the "on" mirror will reflect through the projection lens to the screen. Light hitting the "off" mirror will reflect to a light absorber. Each mirror is individually controlled and independent of the other mirrors. Each frame of a movie is separated into red, blue, and green components and digitized into, for example, 1,310,000 samples representing sub-pixel components for each color. Each mirror in the system is controlled by one of these samples. By using a color filter wheel between the light and the DMD, and by varying the amount of time each individual DMD mirror pixel is on, a full-color, digital picture is projected onto the screen.

Given these various types of displays and others, it is apparent that it would be beneficial to have universal components for processing video data to the displays.

In one embodiment of the invention, an apparatus for re-ordering video data for a display is provided. The apparatus includes a) a means for receiving video data and performing a first transpose process on such video data to create partially re-ordered video data, b) a means for storing the partially re-ordered video data, and c) a means (22, 122) for reading the partially re-ordered video data and performing a second transpose process on such partially re-ordered video data to create fully re-ordered video data.

In one aspect, the apparatus is adaptable to re-order video data for two or more types of displays. In another aspect, the apparatus includes a first transpose processor, a storage module, and a second transpose processor.

One advantage of the invention is that the apparatus is compatible with various types of displays (e.g., PDPs, DMDs, LCOS devices, and transpose scan CRTs) and thereby generic or universal.

Another advantage is a reduction in unique designs for apparatuses that re-order or transpose video data for displays.

Another advantage is the increased efficiency in conversion of video data to sub-field data for PDPs and DMDs, particularly the increased efficiency of associated memory accesses.

An additional advantage is reduction in development efforts for display processing systems.

Other advantages will become apparent to those of ordinary skill in the art upon reading and understanding the following detailed description.

The drawings are for purposes of illustrating exemplary embodiments of the invention and are not to be construed as limiting the invention to such embodiments. It is understood that the invention may take form in various components and arrangement of components and in various steps and arrangement of steps beyond those provided in the drawings and associated description. Within the drawings, like reference numerals denote like elements and similar reference numerals (e.g., 20, 120) denote similar elements.

Figure 1:
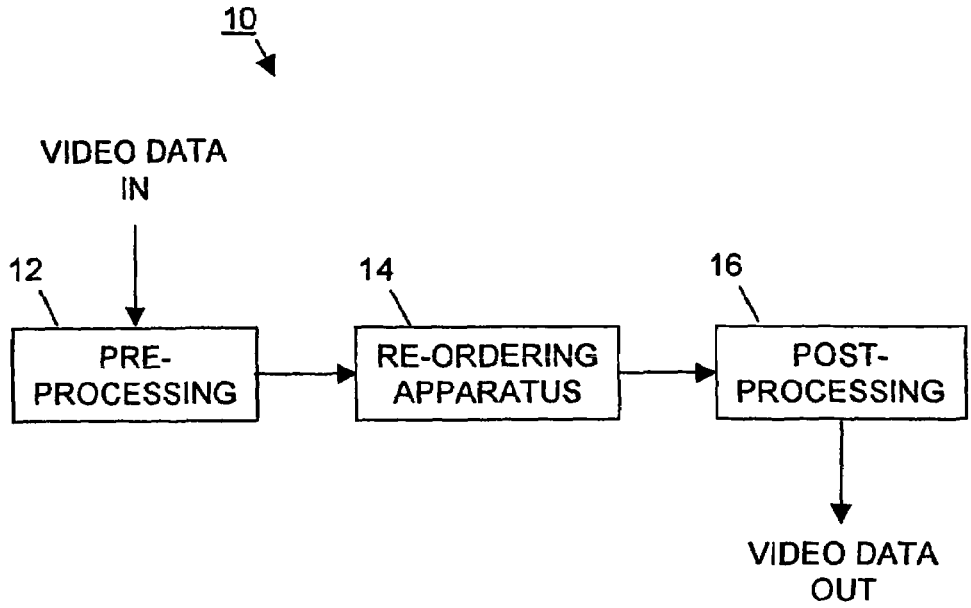
FIG. 1 is a block diagram showing a re-ordering apparatus within an embodiment of a display processing system.

With reference to FIG. 1, a display processing system 10 includes a pre-processing module 12, a re-ordering apparatus 14, and a post-processing module 16. The pre-processing module 12 receives video data and performs certain general image processing steps. Pre-processing may include, for example, image enhancement (e.g., color correction, gamma correction, and/or uniformity correction), motion portrayal enhancements, and/or scaling. The re-ordering apparatus 12 receives pre-processed video data from the pre-processing module and performs certain steps to re-order or transpose the pre-processed video data. Transposing may include, for example, converting a horizontal scan video data stream into a vertical scan video data stream, separation of composite RGB video data into its constituent red (R), green (G), and blue (B) color separations and constructing a video data stream of downward vertically scrolling R, G, and B horizontal color bars, and/or separation of one or more colors into time-based sub-fields to individually control pixel intensity in a display device. Transposing may also include re-ordering of interlaced video data into progressive frames of video data or vice versa. The post-processing module 16 receives the transposed video data and performs certain post-processing steps in order to drive a selected display device.

Typically, the display processing system 10 is embodied in one or more printed circuit card assemblies. The re-ordering apparatus 14 is typically implemented in one or more integrated circuit (IC) devices. In a preferred embodiment, the re-ordering apparatus 14 is programmable. In another embodiment, the re-ordering apparatus 14 is one or more application specific ICs (ASICs). Additional embodiments of the display processing system 10 and the re-ordering apparatus 14 are also possible.

Figure 2:
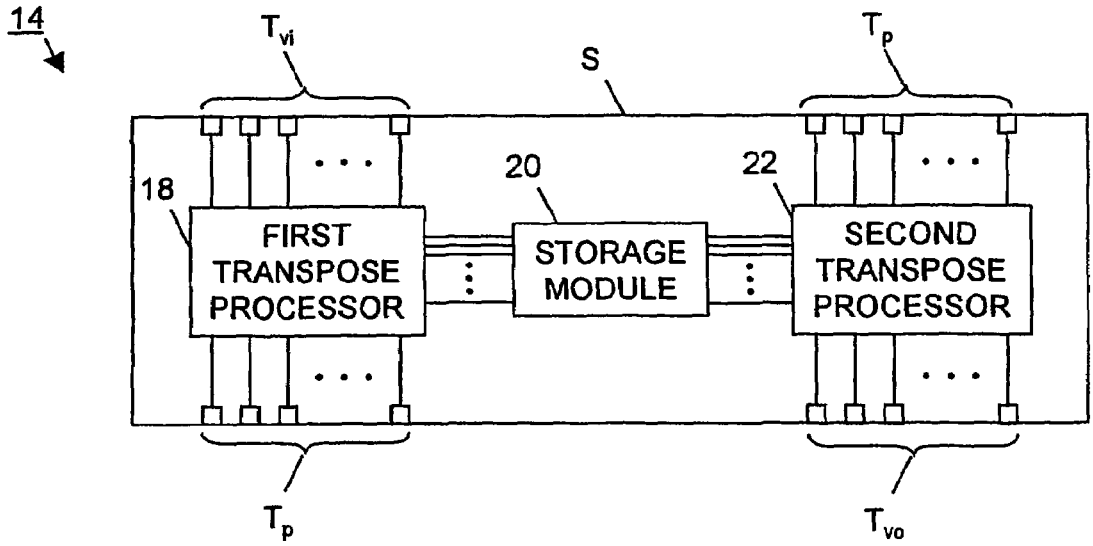
FIG. 2 is a block diagram of an embodiment of the re-ordering apparatus.

With reference to FIG. 2, the re-ordering apparatus 14 includes a first transpose processor 18, a storage module or memory 20, and a second transpose processor 22. The first transpose processor 18 receives pre-processed video data, performs preprogrammed steps to partially transpose the video data, and writes the partially transposed video data to the storage module 20. The storage module 20 stores the partially transposed video data in one or more blocks of memory, also referred to as frame buffers. The second transpose processor 22 reads the partially transposed video data from the storage module 20, performs certain steps to complete the re-ordering or transposing of the video data, and communicates the transposed video data to the post-processing module 16.

In a preferred embodiment, the first transpose processor 18, storage module 20, and second transpose processor 22 are fabricated on a common substrate S to define a unitary programmable IC. The IC includes video input terminals $T_{vi}$, re-ordered video output terminals $T_{vo}$, and terminals $T_p$ for programming or "burning" of internal programmable components or devices (i.e., flexible hardware blocks). In another embodiment, the first transpose processor 18 and second transpose processor 22 are combined in a programmable IC and the storage module 20 includes one or more connectable video RAM ICs. In still another embodiment, the first transpose processor 22 includes a first programmable IC, the storage module 20 includes one or more additional ICs, and the second transpose processor 22 includes a second programmable IC. In yet another embodiment the first transpose processor 18, storage module 20, and second transpose processor 22 are combined in an ASIC. In yet another embodiment, the first and second transpose processors 18, 22 may be arranged in one or more ASICs and the storage module 20 may include one or more additional ICs. Additional embodiments of the re-ordering apparatus 14 are also contemplated.

Figure 3:
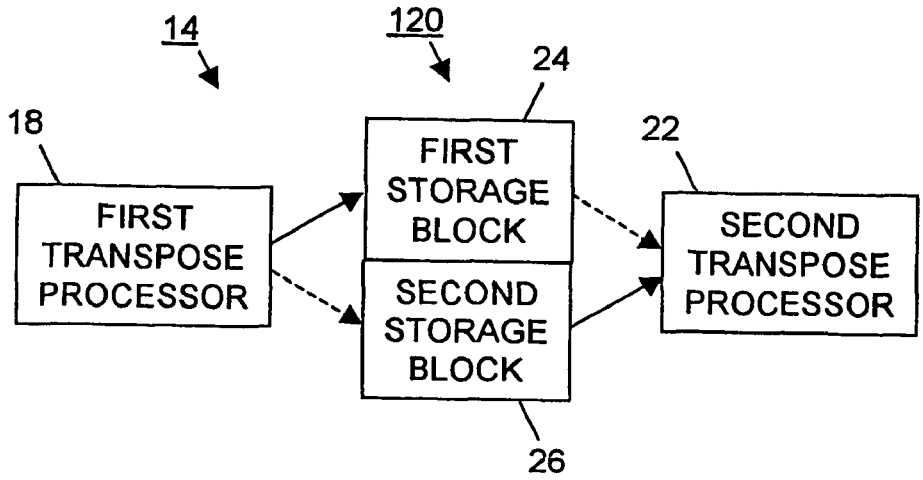
FIG. 3 is a block diagram of another embodiment of the re-ordering apparatus.

With reference to FIG. 3, another embodiment of the re-ordering apparatus 14 includes a storage module 120 with the first and second transpose processors 18, 22. The storage module 120 further includes a memory that is segmentable into a first storage block 24 and a second storage block 26. The first and second storage blocks 24, 26 are used in ping-pong fashion by the first and second transpose processors 18, 22. In other words, while the first transpose processor 18 writes partially transposed video data to one or more frame buffers in the first storage block 24, the second transpose processor 22 reads the partially transposed video data from one or more frame buffers in the second storage block 26. Once these read and write operations are complete, the first and second transpose processors 18, 22 switch to perform read and write operations on the alternate storage block (i.e., 26, 24). These alternating cycles continue in ping-pong fashion as long as video data is being processed.

Figure 4:
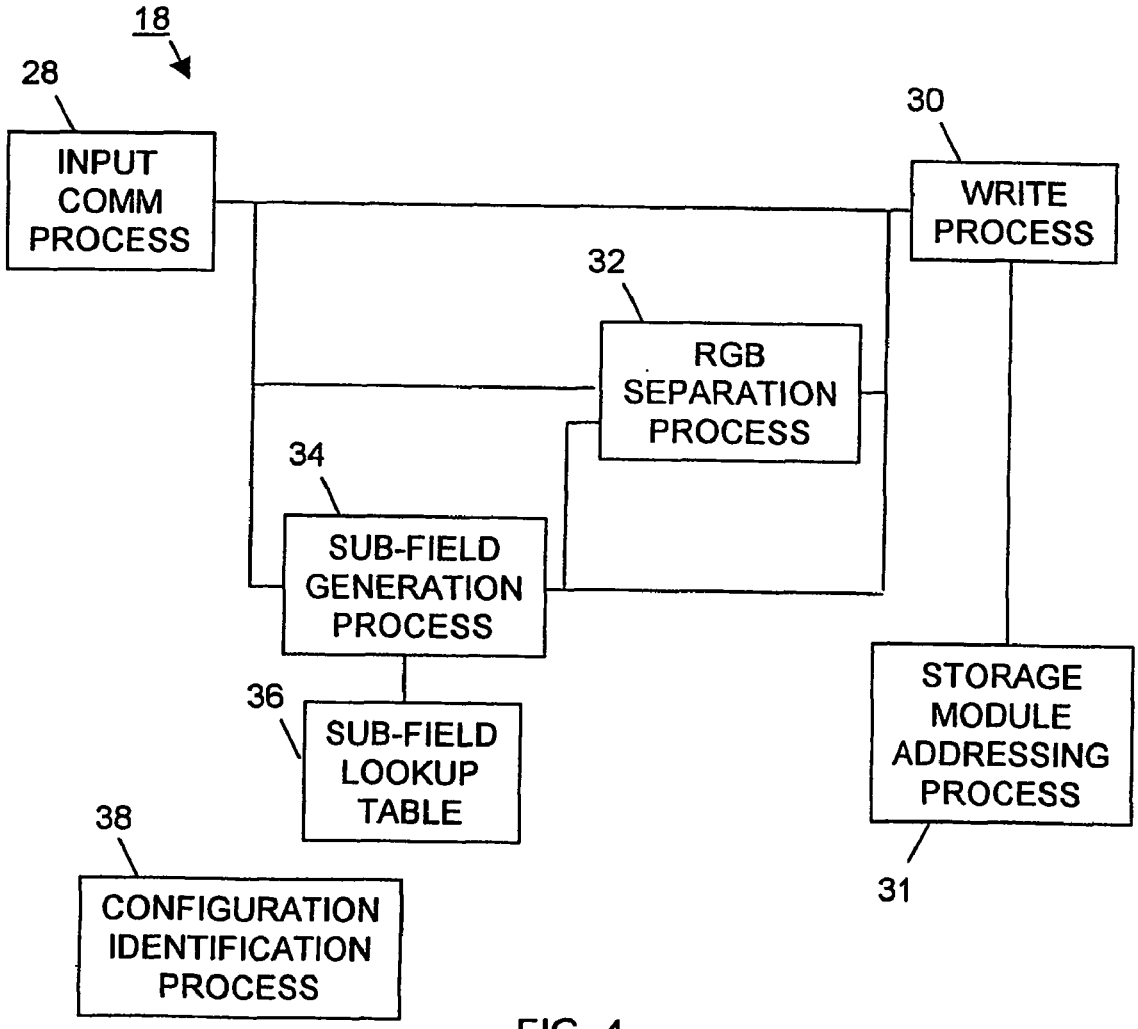
FIG. 4 is a block diagram of an exemplary embodiment of a first transpose processor of the re-ordering apparatus.

With reference to FIG. 4, an exemplary embodiment of the first transpose processor 18 includes an input communication process 28, a write process 30, a storage module addressing process 31, an RGB separation process 32, a sub-field generation process 34, a sub-field lookup table 36, and a configuration identification process 38. Other embodiments of the first transpose processor 18 may be created from various combinations of these processes. In any of these various embodiments and others, the first transpose processor 18 may also include additional processes associated with the partial re-ordering or transposing of video data. For example, a color space conversion process, a special effects process, etc. may be included (if it is not performed as part of pre-processing).

In the embodiment being described, the input communication process 28 receives pre-processed video data from the pre-processing module and provides the pre-processed video data to one or more of the other processes. As shown, the input communication process 28 is in communication with the write process 30, the RGB separation process 32, and the sub-field generation process 34. Typically, the pre-processed video data is a stream of RGB video data. However, other forms of video data (e.g., monochrome or YUV video data) are also possible.

The RGB separation process 32 separates RGB video data into separate R, G, and B video data streams. As shown, the separate R, G, and B video data streams are communicated to the write process 30 and the sub-field generation process 34.

The sub-field generation process 34 receives a video data stream and converts each pixel of the video data stream into data bits for N sub-fields (i.e., sub-field 0 through sub-field N−1) using the sub-field lookup table 36. The sub-field lookup table 36 stores a previously defined cross-reference between pixel data values and a corresponding set of N sub-field bit values for the monochrome and RGB color components. Typically, the sub-field lookup table 36 is embedded memory. Alternatively, the sub-field lookup table 36 can be external memory. The sub-field lookup table 36 may be a block of memory associated with one or more components making up the storage module 20, 120. As shown, a sub-field data stream is communicated to the write process 30 and the RGB separation process 32.

The RGB separation process 32 separates RGB video data into separate R, G, and B video data streams and RGB sub-field data into R, G, and B sub-field data streams. As shown, the separate R, G, and B video and sub-field data streams are communicated to the write process 30.

In a first exemplary operation, the first transpose processor 18 receives a pre-processed stream of RGB video data at the input communication process 28 and provides the pre-processed video data to the write process 30. The storage module addressing process 31 includes one or more address pointers, a process for incrementing the address pointers, a process for determining when the total number of pixels and/or scan lines to be written during a frame repetition cycle have been written, and a process for resetting the address pointers when the repetition cycle is complete. The video data address process 31 provides address information to the write process 30. The write process 30 writes the pre-processed stream of RGB video data to a frame buffer in the storage module 20, 120 allocated to store RGB video data according to the address information. The first transpose process can be viewed as a de-multiplexing operation with respect to the re-ordering of horizontal scan lines into a frame of video data.

If the RGB video data is non-interlaced, the horizontal scan lines are transferred into the frame buffer in sequential and consecutive fashion by the storage module addressing process 31. However, if the non-interlaced RGB video data is to be converted into interlaced RGB video data, the storage module addressing process 31 may direct odd horizontal scan lines to an odd frame buffer and even horizontal scan lines to an even frame buffer. If the RGB video data is interlaced, the storage module addressing process 31 may control transfers of the horizontal scan lines into the frame buffer at spaced intervals to effectively interlace the odd and even horizontal scan lines in the frame buffer. Alternatively, for interlaced RGB video data, the horizontal scan lines may be transferred into the odd and even frame buffers in sequential and consecutive fashion.

In a second exemplary operation, the input communication process 28 provides the pre-processed video data to the RGB separation process 32. The RGB separation process creates separate R, G, and B video data streams and provides them to the write process 30. The write process 30 writes the separate streams of R, G, and B video data to separate frame buffers in the storage module 20, 120 allocated to store R separation, G separation, and B separation video data according to address information provided by the video data address process 31.

In a third exemplary operation, the input communication process 28 provides the pre-processed RGB video data to the sub-field generation process 34. The sub-field generation process 34, in conjunction with the sub-field lookup table 36, creates N sets of RGB sub-field video data and provides them to the write process 30. The write process 30 writes the streams of RGB sub-field video data to frame buffers in the storage module 20, 120 allocated to store RGB sub-field video data according to address information provided by the video data address process 31.

In a fourth exemplary operation, the input communication process 28 provides the pre-processed video data to the sub-field generation process 34. The sub-field generation process 34, in conjunction with the sub-field lookup table 36, creates N sets of sub-field RGB video data and provides them to the RGB separation process 32. The RGB separation process 32 creates separate R, G, and B sub-field video data for each color separation. This results in N sets of R separation sub-field video data, N sets of G separation sub-field video data, and N sets of B separation sub-field video data. The RGB separation process provides the R, G, and B sub-field video data to the write process 30. The write process 30 writes the separate streams of sub-field video data to separate frame buffers in the storage module 20, 120 allocated to store R separation sub-field, G separation sub-field, and B separation sub-field video data according to address information provided by the video data address process 31.

In a fifth exemplary operation, the input communication process 28 provides the pre-processed video data to the sub-field generation process 34. The sub-field generation process 34, in conjunction with the sub-field lookup table 36, creates N sets of monochrome sub-field video data and provides them to the write process 30. The write process 30 writes the streams of monochrome sub-field video data to frame buffers in the storage module 20, 120 allocated to store monochrome sub-field video data according to address information provided by the video data address process 31.

Figure 5A:
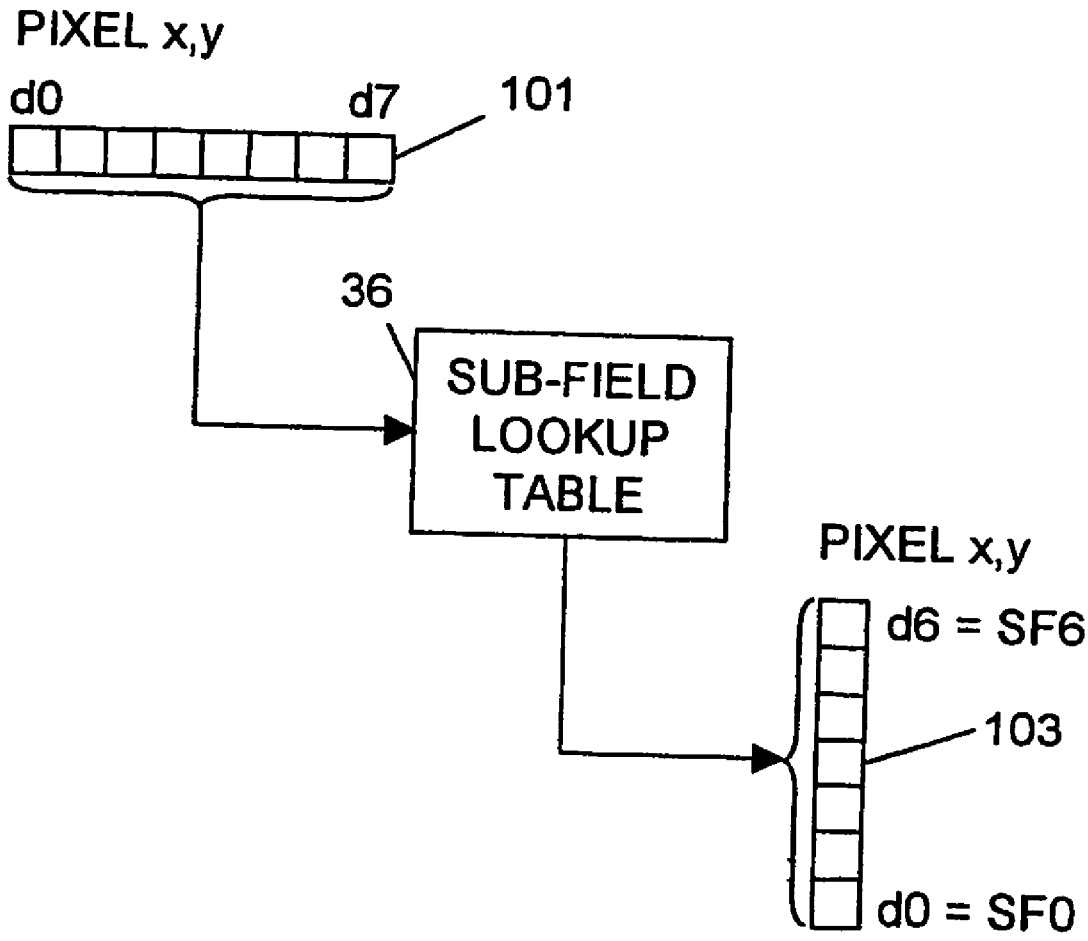
FIG. 5A is an illustrative example of conversion of pixel data to monochrome sub-field data.

FIG. 5A provides an illustrative example of the conversion of pixel data to monochrome sub-field data as required, for example, to transpose video data for monochrome digital micro-mirror devices (DMDs). As shown, pixel data 101 for pixel (x,y) is represented by an 8-bit word 101 (i.e., bits d0-d7). The sub-field lookup table 36 cross-references the 8-bit word 101 to sub-field data 103 for pixel (x,y). In this example, there are seven sub-fields (i.e., sub-field SF0 through sub-field SF6). Pixel (x,y) is represented by one bit in each sub-field. Thus, the monochrome sub-field data for pixel (x,y) is binary.

The conversion illustrated in FIG. 5A is performed for each pixel in a frame of video data. Typically, temporary storage of sub-field data is implemented so that parallel transfers over a data bus can be performed, rather than transferring individual bits. If, for example, the system operates with a 32-bit data bus, it is most efficient to transfer 32 bits of sub-field data in parallel. FIG. 5C provides an illustrative example of temporary storage of sub-field data for an exemplary sub-field (i) within the sub-field generation process 34. In this example, the sub-field generation process 34 includes a plurality of shift registers for temporary storage. As shown in FIG. 5A, the sub-field generation process provides 1-bit binary data in each sub-field for each pixel of the frame. For example, SF i, di (item 127) represents the 1-bit binary data output for sub-field (i) for a given pixel. This sub-field data is temporarily stored by transferring it through a series of shift registers (129, 131, 133, 135). For example, in our example with a 32-bit data bus, there are 32 shift registers. The sub-field data for a first pixel (i.e., $di_{0,0}$) is initially transferred to a first shift register 129. When the sub-field data for a second pixel (i.e., $di_{0,1}$) is ready to be transferred, sub-field data $di_{0,0}$ is shifted to the next shift register 131 and sub-field data $di_{0,1}$ is transferred to the first shift register 129. This process continues until sub-field data for the last pixel (i.e., $di_{x,y}$) in the block is transferred to the first shift register 129 which is the condition shown in FIG. 5C. Note that the sub-field data $di_{0,1}$ for the first pixel has been shifted to the last shift register 135 and sub-field data $di_{0,1}$ for the second pixel has been shifted to the next to last shift register 133. At this point, the write process 30 transfers a first word of sub-field data for sub-field (i) in parallel from the temporary shift registers to a frame buffer 137 in the storage module 20, 120 allocated for storage of sub-field (i).

Of course, the entire process shown in FIG. 5C is performed in parallel for each sub-field (e.g., SF0 through SF6). Additionally, the total structure of shift registers is implemented twice and operated in a ping-pong fashion. In other words while one set of shift registers is performing the serial transfers described above, the other set is performing the parallel transfer and vice versa. Ping-pong operation continues until RGB sub-field data has been generated and stored for the entire frame. The overall process is repeated for each frame.

Figure 5B:
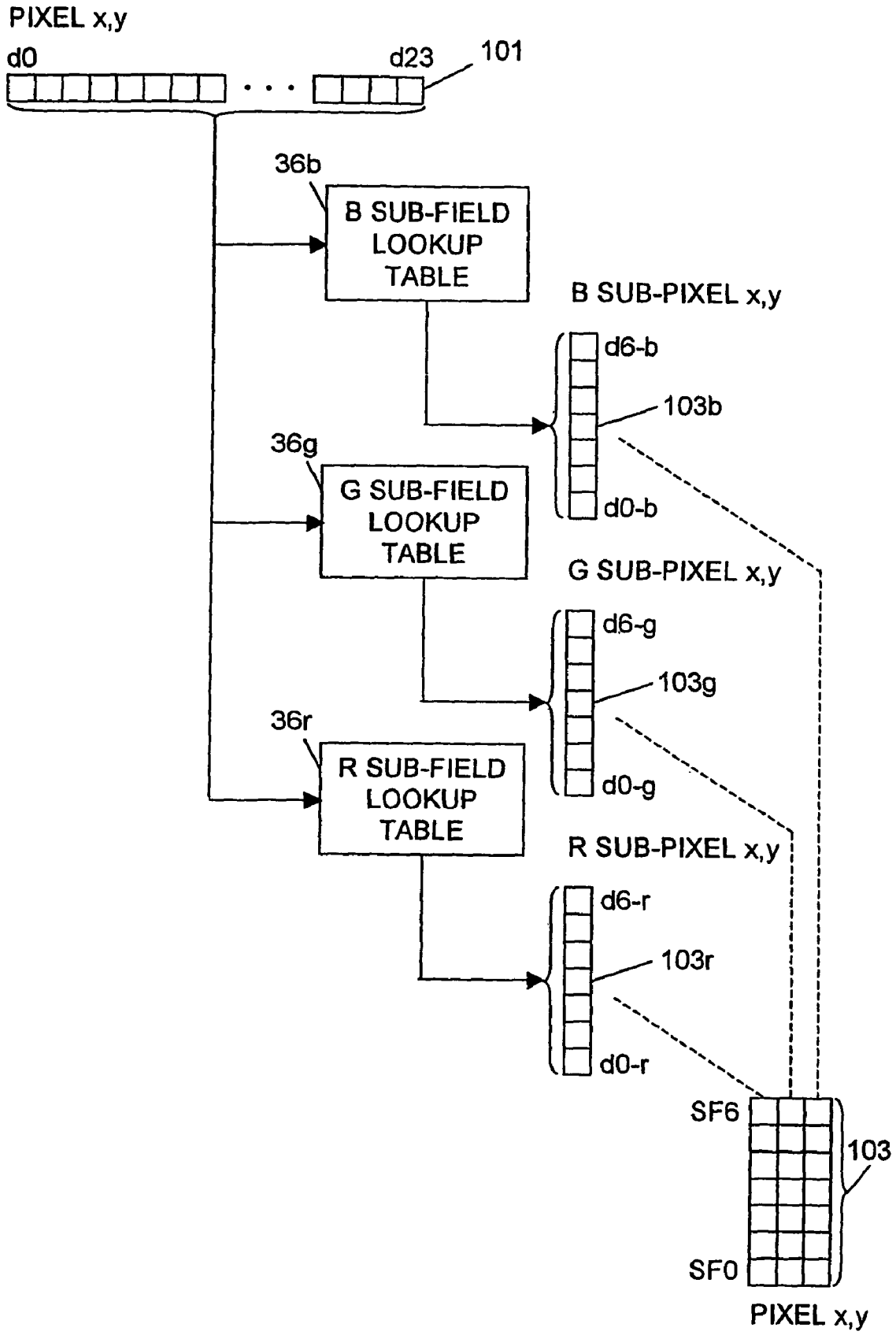
FIG. 5B is an illustrative example of conversion of pixel data to R, G, and B sub-field data.
Figure 5C:
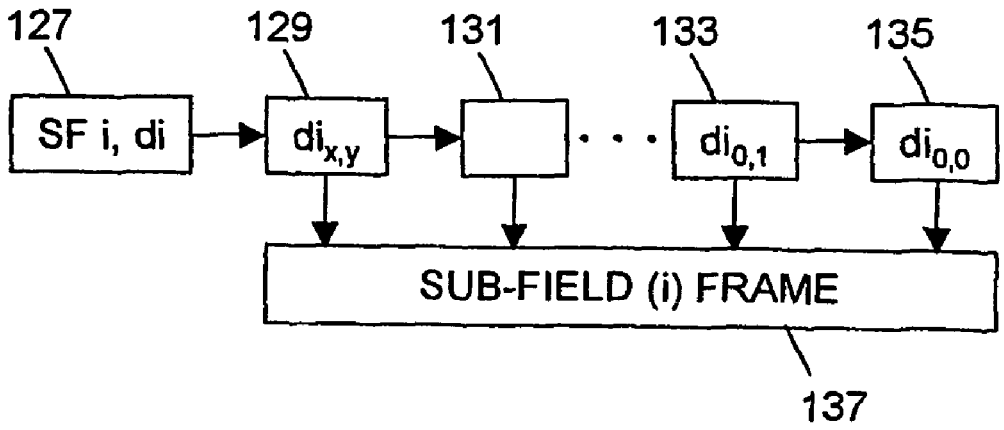
FIG. 5C is an illustrative example of temporary storage of sub-field data for an exemplary sub-field (i).

FIG. 5B provides an illustrative example of the conversion of pixel data to RGB sub-field data as required, for example, to transpose video data for plasma display panels (PDPs) and color DMDs. As shown, pixel data 101 for pixel (x,y) is represented by a 24-bit word 101 (i.e., bits d0-d23). The R sub-field lookup table 36*r* cross-references eight bits of the 24-bit word 101 that specify the red color component to R sub-pixel data 103*r* as a first component of the sub-field data 103 for pixel (x,y). Likewise, the G sub-field lookup table 36*g* cross-references eight bits of the 24-bit word 101 that specify the green color component to G sub-pixel data 103*g* as one component of the sub-field data 103 for pixel (x,y). Additionally, the B sub-field lookup table 36*b* cross-references eight bits of the 24 bit word 101 that specify the blue color component to B sub-pixel data 103*b* as one component of the sub-field data 103 for pixel (x,y). In this example, there are seven RGB sub-fields (i.e., sub-field SF0 through sub-field SF6). Pixel (x,y) is represented by three bits in each sub-field, a first bit (i.e., d0-*r* through d6-*r*) representing R sub-pixel data, a second bit (i.e., d0-*g* through d6-*g*) representing G sub-pixel data, and a third bit (i.e., d0-b through d6-*b*) representing B sub-pixel data for the sub-fields 103. Thus, the RGB sub-field data for pixel (x,y) is 3-bit binary.

Figure 5D:
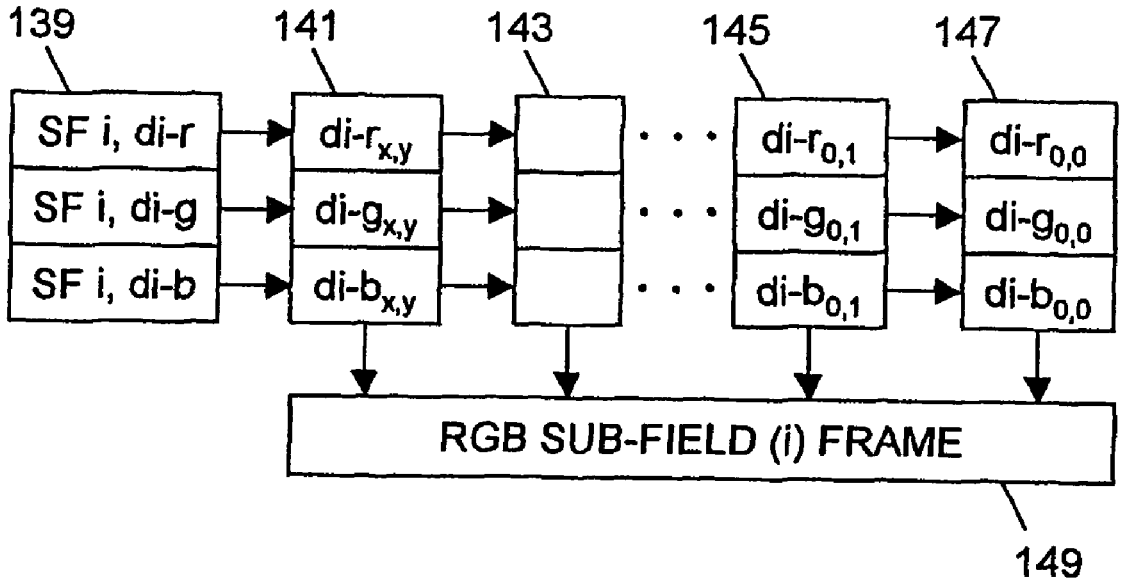
FIG. 5D is an illustrative example of temporary storage of RGB sub-field data for an exemplary RGB sub-field (i).

FIG. 5D provides an illustrative example of temporary storage of RGB sub-field data for an exemplary RGB sub-field (i) within the sub-field generation process 34. In this example, similar to FIG. 5C, the sub-field generation process 34 includes a plurality of shift registers for temporary storage. However, as shown in FIG. 5B, the RGB sub-field generation process provides 3-bit binary data in each RGB sub-field for each pixel of the frame. For example, di-r, di-g, and di-b (item 139) represents the 3-bit binary data output for RGB sub-field (i) for a given pixel. This RGB sub-field data is temporarily stored by transferring it through a series of 3-bit shift registers (141, 143, 145). Again, in our example with a 32-bit data bus, there are 32 shift registers. The RGB sub-field data for a first pixel (i.e., $di\text{-}r_{0,1}$, $di\text{-}g_{0,1}$ $di\text{-}b_{0,1}$) is initially transferred to a first shift register 141. When the RGB sub-field data for a second pixel (i.e., $di\text{-}r_{0,0}$, $di\text{-}g_{0,0}$ $di\text{-}b_{0,1}$) is ready to be transferred, RGB sub-field data $di\text{-}r_{0,0}$, $di\text{-}g_{0,0}$ $di\text{-}b_{0,0}$ is shifted to the next shift register 143 and RGB sub-field data $di\text{-}r_{0,1}$, $di\text{-}g_{0,1}$ $di\text{-}b_{0,1}$ is transferred to the first shift register 141. This process continues until RGB sub-field data for the last pixel (i.e., $di\text{-}r_{x,y}$, $di\text{-}g_{x,y}$ $di\text{-}b_{x,y}$) in the block is transferred to the first shift register 141 which is the condition shown in FIG. 5D. Note that the RGB sub-field data $di\text{-}r_{0,0}$, $di\text{-}g_{0,0}$ $di\text{-}b_{0,0}$ for the first pixel has been shifted to the last shift register 147 and RGB sub-field data $di\text{-}r_{0,1}$, $di\text{-}g_{0,1}$ $di\text{-}b_{0,1}$ for the second pixel has been shifted to the next to last shift register 145. At this point, the write process 30 transfers a first word of RGB sub-field data for RGB sub-field (i) in parallel from the temporary shift registers to an RGB frame buffer 149 in the storage module 20, 120 allocated for storage of RGB sub-field (i).

Of course, like the process of FIG. 5C, the entire process shown in FIG. 5D is performed in parallel for each RGB sub-field (e.g., SF0 through SF6). Additionally, the total structure of shift registers is implemented twice and operated in a ping-pong fashion until RGB sub-field data has been generated and stored for the entire frame. The overall process is repeated for each frame.

Referring more generally to the sub-field generation process 34 (FIG. 4), each sub-field of the N sub-fields corresponds to a previously defined unit of time. Typically, sub-field 0 is defined by a basic unit of time ($t^0$), sub-field 1 is defined by $t^1$, etc., and sub-field N−1 is defined by $t^{N-1}$. However, alternate schemes for time units and scaling are possible. Selection of time unit values and/or scaling could be variable for compatibility with multiple types of display devices that implement different time units and/or different scaling schemes.

Figure 6:
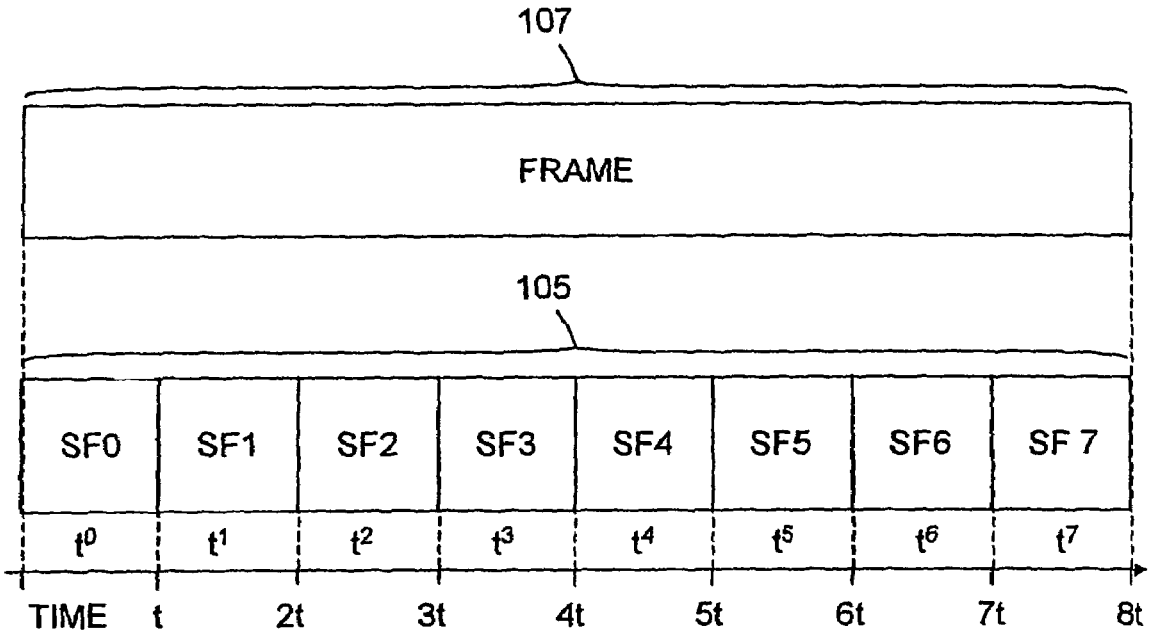
FIG. 6 is an illustrative example of the display of sub-fields over time in relation to the display of a frame of video data.

FIG. 6 provides an illustrative example of the display of eight sub-fields 105 over time in relation to the display of a composite frame of video data 107. It is understood that the displayed sequence of sub-fields produces an image that is generally equivalent to a composite frame of video data. Thus, the sequence of all sub-fields relates to conventional frame repetition rates (e.g., 30 Hz, 60 Hz, etc.). In this example, the basic time unit is t and each sub-field is displayed for time t. Thus, sub-field SF0 is displayed between 0 and t, sub-field SF1 is displayed between t and 2*t*, etc., and sub-field SF7 is displayed between 7*t* and 8*t*. The total time (8*t*) to display the eight sub-fields (i.e., SF0-SF7) corresponds to conventional frame rates. If, for example, the conventional frame repetition rate is 50 Hz, the sub-field display rate for this example is approximately 400 Hz.

Since each sub-field corresponds to a unit of time, the combination of 1's and 0's in the sub-field data bits determines a percentage of time that the corresponding pixel will be illuminated during each composite frame of video data. Conversion of pixel data to a set of sub-field bits is useful for driving display devices comprised of a matrix of individually controlled components (e.g., PDPs, DMDs, etc.). Typically, each of these individually controlled components is associated with a pixel or sub-pixel in the image to be displayed. Varying the amount of time the component is on/off controls the intensity of each individually controlled component. Differences in intensity result in different shades of color for individual pixels in the displayed image.

With continued reference to FIG. 4, an embodiment of the first transpose processor 18 that includes the input communication process 28, write process 30, and storage module addressing process 31 is compatible with transpose scan cathode ray tubes (CRTs), re-ordering of interlaced video data to non-interlaced video data, and vice versa. An embodiment of the first transpose processor 18 that includes the input communication process 28, RGB separation process 32, write process 30, and storage module addressing process 31 is compatible with liquid crystal on silicon (LCOS) devices. An embodiment of the first transpose processor 18 that includes the input communication process 28, sub-field generation process 34, sub-field lookup table 36, write process 30, and storage module addressing process 31 is compatible with PDPs and monochrome DMDs. An embodiment of the first transpose processor 18 that includes the input communication process 28, RGB separation process 32, sub-field generation process 34, sub-field lookup table 36, write process 30, and storage module addressing process 31 is compatible with color DMDs.

The configuration identification process 38 in the first transpose processor 18 facilitates use of the re-ordering apparatus 14 in various dedicated display processing systems 10. For example, when a display processing system 10 is manufactured for a dedicated display device, the configuration identification process 38 can be used to tailor the active processes within the first transpose processor 18 to those associated with the dedicated display device. Thus, the generic processes associated with the first transpose processor 18 can be activated or deactivated to increase processing efficiency.

Figure 7:
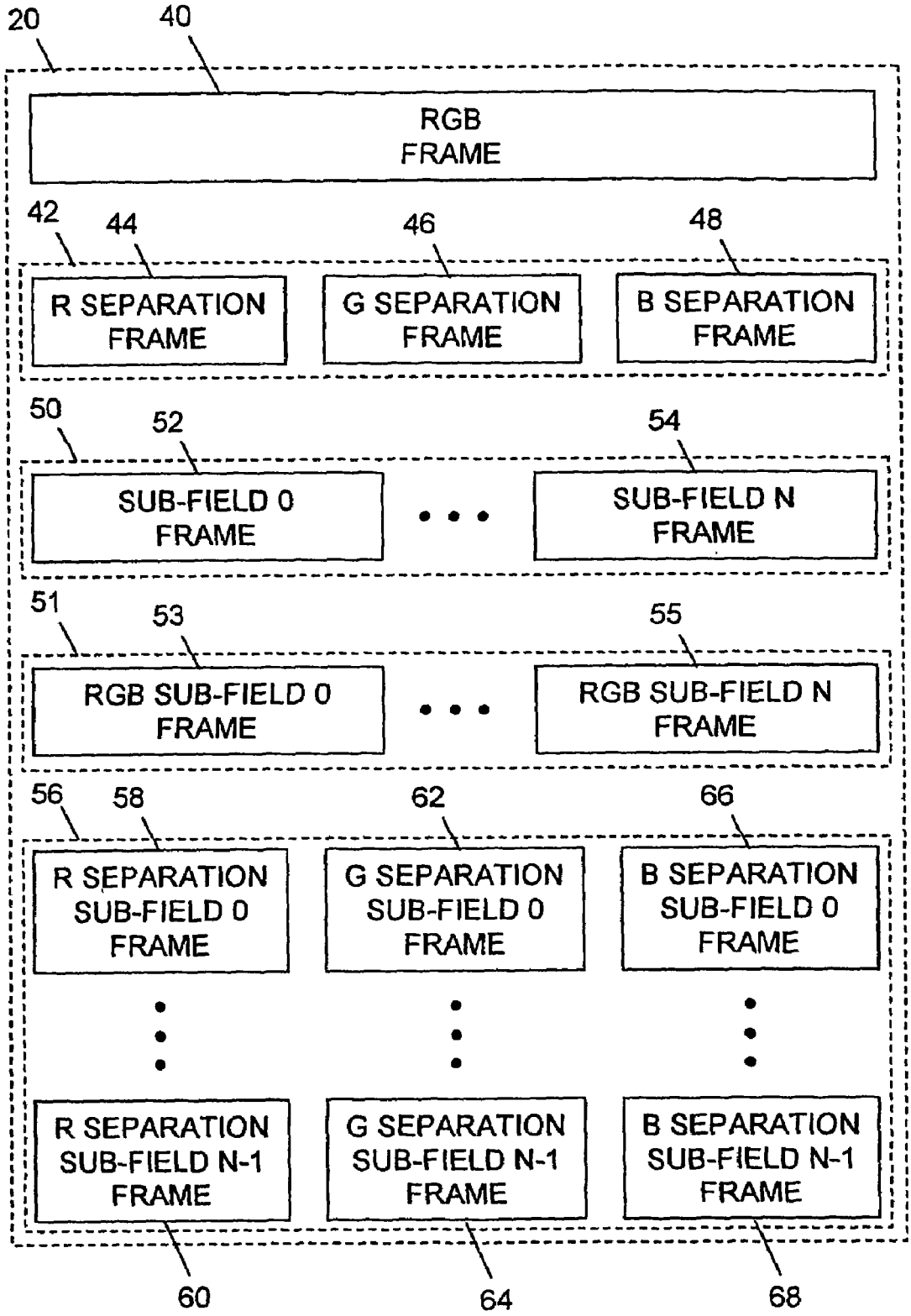
FIG. 7 is a block diagram of an exemplary embodiment of a storage module of the re-ordering apparatus.

With reference to FIG. 7, an exemplary embodiment of a storage module 20 includes one or more memory blocks. Each memory block stores partially transposed video data from the first transpose processor 18 in one or more frame buffers. A first memory block 40 is allocated for storing partially transposed video data associated with a composite RGB frame in an RGB frame buffer. The first memory block 40 is compatible with transpose scan CRTs. The first memory block 40 is also compatible with re-ordering interlaced video data into non-interlaced video data if the first transpose processor combines the odd and even horizontal scan lines. If the second transpose processor combines the odd and even horizontal scan lines, the first memory block 40 includes an odd sub-block to store the odd horizontal scan line and an even sub-block to store the even horizontal scan lines. Additionally, the first memory block 40 is compatible with re-ordering non-interlaced video data into interlaced video data if the second transpose processor separates the odd and even horizontal scan lines. If the first transpose processor separates the odd and even horizontal scan lines, the first memory block 40 includes an odd sub-block to store the odd horizontal scan line and an even sub-block to store the even horizontal scan lines.

A second memory block 42 is allocated for storing partially transposed video data associated with separate R, G, and B frames. Three memory sub-blocks 44, 46, 48 are allocated within the second memory block 42 as R separation, G separation, and B separation frame buffers, respectively, to store the separated R, G, and B video data. The second memory block 42 is compatible with LCOS devices.

A third memory block 50 is allocated for storing partially transposed video data associated with N sub-fields. N sub-blocks (e.g., 52, 54) are allocated within the third memory block 50 as sub-fields 0 through N−1 frame buffers to store sub-field video data. The third memory block 50 is compatible with monochrome DMDs.

A fourth memory block 51 is allocated for storing partially transposed video data associated with N RGB sub-fields. N sub-blocks (e.g., 53, 55) are allocated within the fourth memory block 51 as RGB sub-field 0 through N−1 frame buffers to store RGB sub-field video data. The fourth memory block 51 is compatible with PDPs.

A fifth memory block 56 is allocated for storing partially transposed video data associated with N sub-fields for each of R, G, and B color separations. N sub-blocks (e.g., 58, 60) are allocated as R separation sub-fields 0 through N−1 to store sub-field video data associated with the R color separation. Likewise, N sub-blocks (e.g., 62, 64) are allocated as G separation sub-fields 0 through N−1 to store sub-field video data associated with the G color separation and N sub-blocks (e.g., 66, 68) are allocated to store like sub-fields associated with the G color separation. Therefore, given N sub-fields for each color separation, the fourth memory block 56 includes 3N sub-blocks. The fifth memory block 56 is compatible with color DMDs.

In various other embodiments, the storage module 20 may include any combination of the first, second, third, fourth, and fifth memory blocks. Additional memory blocks for storage of other types of partially transposed video data frames are also possible. Moreover, the configuration of memory blocks shown in FIG. 7 and any other configuration can have duplicate memory blocks for alternating between write and read operations in a ping-pong fashion as described above in reference to FIG. 3.

Of course, in embodiments where the re-ordering apparatus is not required to simultaneously support each type of re-ordering, certain memory blocks can share physical memory. For example, if transpose scan CRT re-ordering is required at a particular time, the first memory block can overlay the second, third, fourth, and fifth memory block. Similarly, if only color DMD re-ordering is required at a particular time, the fifth memory block can overlay the first, second, third, and fourth memory blocks. Typically, the generic re-ordering apparatus is ultimately dedicated to one type of re-ordering and the physical memory is sized for the re-ordering processing that requires the most memory.

Figure 8:
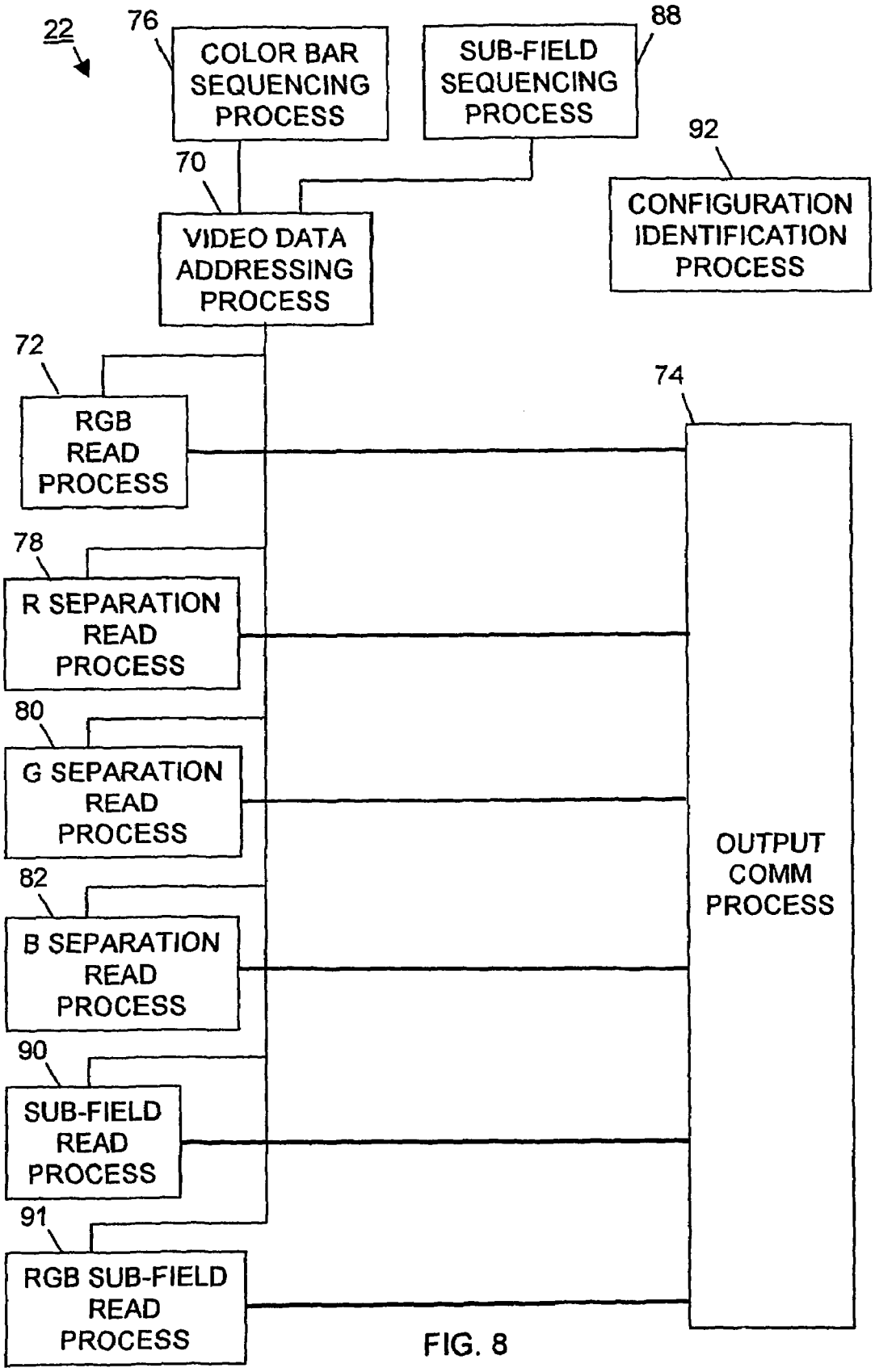
FIG. 8 is a block diagram of an exemplary embodiment of a second transpose processor of the re-ordering apparatus.

With reference to FIG. 8, an exemplary embodiment of the second transpose processor 22 includes a video data addressing process 70, an RGB read process 72, an output communication process 74, a color bar sequencing process 76, an R separation read process 78, a G separation read process 80, a B separation read process 82, a sub-field sequencing process 88, a sub-field read process 90, an RGB sub-field read process 91, and a configuration identification process 92. Other embodiments of the second transpose processor 22 may be created from various combinations of these processes. In any of these various embodiments and others, the second transpose processor 22 may also include additional processes associated with the re-ordering or transposing of video data. For example, a process to combine color separations, a special effects process, etc. may be included (if it is not performed as part of post-processing).

In the embodiment being described, the video data addressing process 70 includes one or more address pointers for locating video data in frame buffers of the storage module 20, 120, a process for incrementing the address pointers, a process for determining when the total number of pixels and/or scan lines to be read during a frame repetition cycle have been read, and a process for resetting the address pointers when the repetition cycle is complete. As shown, the video data addressing process 70 is in communication with the RGB read process 72, R separation read process 78, G separation read process 80, B separation read process 82, sub-field read process 90, and RGB sub-field read process 91. Alternate methods of addressing video data in the frame buffers are also possible.

The RGB read process 72 receives address information from the video data addressing process 70 and sequentially reads pixel data from the RGB frame buffer 40. Typically, the address information from the video data address process 70 to the RGB read process 72 is incremented in a manner so that the pixel data read from the RGB frame buffer forms descending vertical scan lines that move from left to right across the frame. The RGB read process 72 provides this transposed RGB video data stream to the output communication process 74. The output communication process 74 provides the transposed RGB video data stream to the post-processing module 16. As described above, the transposed RGB video data stream provided by the second transpose processor 22 is compatible with transpose scan CRTs.

Alternatively, the video data address process 70 may be incremented in a manner so that the pixel data read from the RGB frame buffer form scan lines in other suitable orientations. Moreover, the scan lines may be advanced right or left and/or up or down, depending the desired characteristics for compatibility with various displays.

If the RGB video data is non-interlaced, the scan lines are read from the frame buffer in sequential and consecutive fashion by the RGB read process 72 as directed by the video data addressing process 70. However, if the non-interlaced RGB video data is to be converted into interlaced RGB video data, the video data addressing process 70 direct the RGB read process 72 to construct two interlaced frames from each frame of video data in the RGB frame buffer. In a first interlaced frame, the RGB read process 72 reads odd scan lines from the RGB frame buffer. Then, in a second interlaced frame, the RGB read process 72 reads even scan lines from the RGB frame buffer. If the first transpose processor has already separated the odd and even scan lines, the video data addressing process 70 directs the RGB read process 72 to the odd frame buffer and then to the even frame buffer. Of course, in any of these processes the sequence can be reversed to even and then odd.

If the RGB video data is interlaced and is to be converted to non-interlaced, the video data addressing process 70 directs the RGB read process 72 to alternate between reading an odd scan line from the odd frame buffer and an even scan line from the even frame buffer. If the first transpose processor has already combined the odd and even scan lines, the video data addressing processor 70 directs the RGB read process 72 to read scan lines sequentially and consecutively from the RGB frame buffer.

Figure 9:
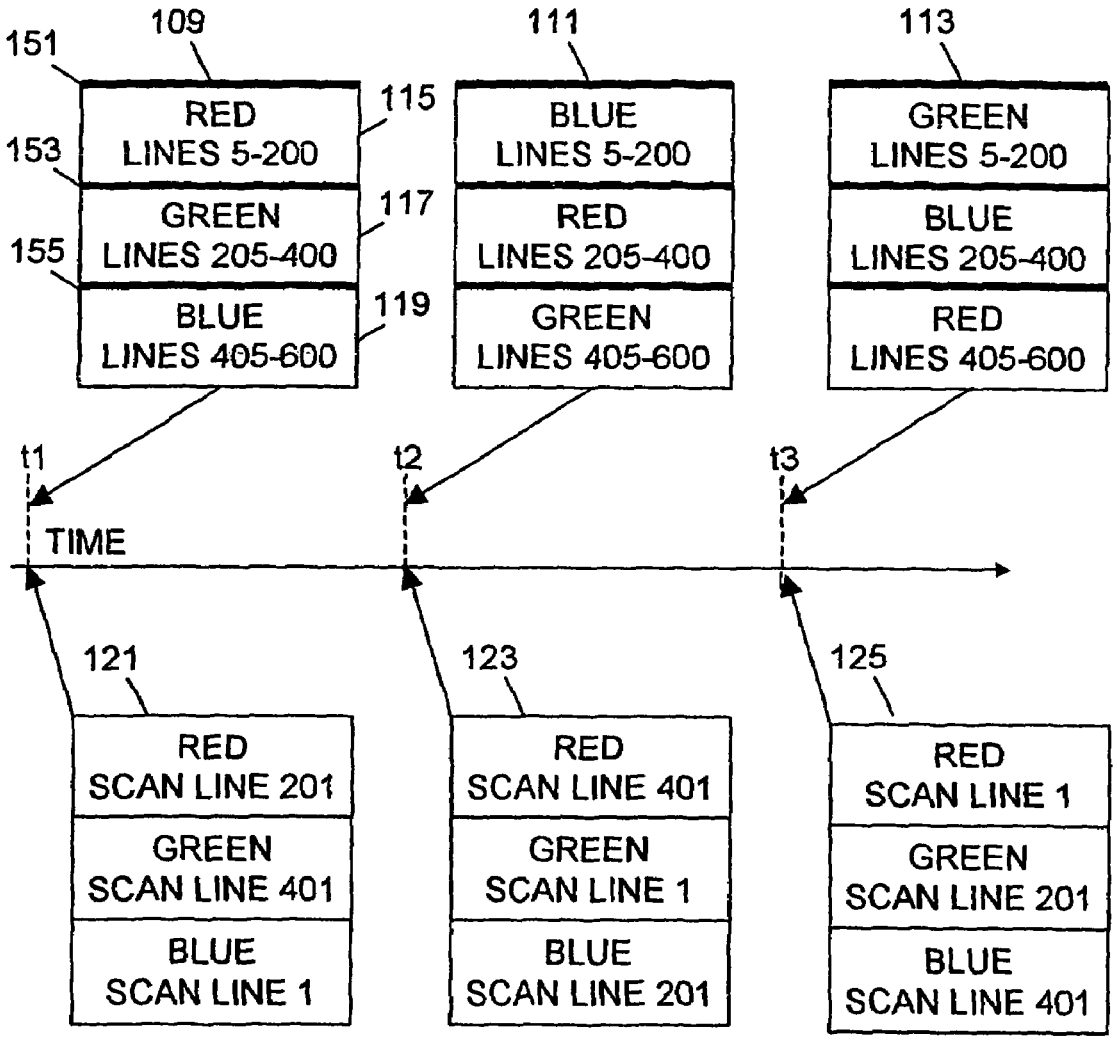
FIG. 9 is an illustrative example of a sequence for three scrolling color bars over time in relation to the display of a frame of video data

The color bar sequencing process 76 is based on display types that display an illumination pattern with a sequence of color bars (e.g., LCOS devices). Typically, there are three color bars in the sequence (FIG. 9, items 109, 111, 113). Normally, the sequence is red-green-blue from top to bottom (e.g., item 115, 117, 119), although other sequences are possible. The color bar sequencing process 76 also includes a value associated with the number of horizontal scan lines in each color bar. Typically, each color bar has the same number of horizontal scan lines. Thus, the number of scan lines in each bar is usually approximately one third of the horizontal scan lines in the R, G, and B separation frame buffers 44, 46, 48 and the subsequent frames to be rendered on a selected display. For example, if the frames include 600 horizontal scan lines, each color bar (items 115, 117, 119) includes approximately 200 scan lines. The illumination pattern also includes horizontal black bars (e.g., three or four scan lines) (items 151, 153, 155) between the color bars (items 115, 117, 119). Typically, the horizontal black bars are laid over several scan lines by the display device.

Hence, as shown in a view of the illumination pattern at time t1, lines 1-4 are occupied by a first black bar 151; the red color bar 115 is illuminated at lines 5-200; lines 201-204 are occupied by a second black bar 153; the green color bar 117 is illuminated at lines 205-400; lines 401-404 are occupied by a third black bar 155; and the blue color bar 119 is illuminated at lines 405-600. Of course, other schemes for arranging the red, green, and blue color bars and the black bars are possible.

As shown in FIG. 8, the color bar sequencing process 76 is in communication with the video data addressing process 70. The video data addressing process 70 receives sequence and color bar size information from the color bar sequencing process 76 and controls address pointers associated with the R separation, G separation, and B separation frame buffers 44, 46, 48 accordingly. The R separation read process 78 receives address information from the video data addressing process 70 and sequentially reads pixel data from the R separation frame buffer 44. Likewise, the G separation read process 80 receives address information from the video data addressing process 70 and sequentially reads pixel data from the G separation frame buffer 46. The B separation read process 82 also receives address information from the video data addressing process 70 and sequentially reads pixel data from the B separation frame buffer 48.

For example, as shown in FIG. 9, for frames with 600 horizontal scan lines and red-green-blue color bar sequences, at initialization the illumination process begins when horizontal scan line #1 of the R separation frame buffer, horizontal scan line #201 of the G separation frame buffer, and horizontal scan line #401 of the B separation frame buffer are illuminated on the display. In this R, G, B sequence, each scan line is incremented and illuminated on the display until the three color bar illumination pattern is filled. This point is reflected at time t1 in FIG. 9 and depicted by item 109.

At time t1, the update process begins as the color bars are scrolled downward one scan line at a time. For example, at time t1, the R separation read process 78 reads video data from horizontal scan line #201 of the R separation frame buffer 44 and communicates it to the output communication process 74. The G separation read process 80 reads video data from horizontal scan line #401 of the G separation frame buffer 46 and communicates it to the output communication process 74. The B separation read process 82 reads video data from horizontal scan line #1 of the B separation frame buffer 48 and communicates it to the output communication process 74. The output communication process 74 provides the video data for the red, green, and blue scan lines to the post-processing module 16. Note that at time t1 scan lines 1, 201, and 401 are below the black bars 151, 153, 155 and are the next scan line down from the color bars in the illumination pattern.

Next, the color bar sequencing process 76 increments each scan line and the process is repeated. For example, the R separation read process 78 reads scan line #202 from the R separation frame buffer, the G separation read process 80 reads scan line #402 from the G separation frame buffer, and the B separation read process 82 reads scan line #2 from the B separation frame. The color bar update process is continually repeated in this manner. Two hundred scan lines later, at t2, the R separation read process 78 reads scan line #401 from the R separation frame buffer, the G separation read process 80 reads scan line #1 from the G separation frame buffer, and the B separation read process 82 reads scan line #201 from the B separation frame buffer. The corresponding illumination pattern 111 at t2 shows the black bars at the top of blue, red, and green color bars. Similarly, two hundred additional scan lines later, at t3, the R separation read process 78 reads scan line #1 from the R separation frame buffer, the G separation read process 80 reads scan line #201 from the G separation frame buffer, and the B separation read process 82 reads scan line #401 from the B separation frame buffer. The corresponding illumination pattern 113 at t3 shows the black bars at the top of green, blue, and red color bars. At t3, all 600 scan lines for each color separation have been provided for a first frame of video data and a new frame repetition cycle begins.

Referring again to FIG. 8, typically, the address information from the video data address process 70 to the R, G, and B separation read process 78, 80, 82 is incremented in a manner so that the pixel data read from the frame buffers form horizontal scan lines from left to right across the frame that advance downward through the frame buffer. Alternatively, the video data address process 70 may be incremented in a manner so that the pixel data read from the R separation, G separation, and B separation frame buffer form scan lines in other suitable orientations. Moreover, the scan lines may be advanced right or left and/or up or down, depending the desired characteristics for compatibility with various displays.

As described above, FIG. 9 shows that the R, G, and B color bars in the illumination pattern on the device scroll downward and reappear at the top of the frame over time. In the first view of the illumination pattern 109 at t1, the color bars are in a red-green-blue sequence from top to bottom. In the second view of the illumination patter 111 at t2, the color bars have scrolled downward 200 lines. Similarly, in the third view of the illumination pattern 113 at t3, the color bars have scrolled downward another 200 lines. At t3, the second transpose processor 22 is ready to advance to the next frame.

FIG. 9 also shows that, for frames of video data with 600 scan lines, at least 600 sequences of red-green-blue scan lines must be communicated to the post-processing module 16 in order to include all of the scan lines from each of the color separation frames during a frame repetition cycle. It also shows that each sequence of red-green-blue scan lines should be communicated at a consistent interval. As described above, the transposed video data stream provided by the second transpose processor 22 is compatible with LCOS devices.

Returning to FIG. 8, the sub-field sequencing process 88 includes a value associated with the number of sub-fields generated, a sequence for reading the sub-fields, and a value associated with the amount of time each sub-field is to be displayed. The sub-field sequencing process 88 is in communication with the video data addressing process 70. The video data addressing process 70 receives sub-field information from the sub-field sequencing process 88 and controls address pointers associated with the sub-field 0 through sub-field N frame buffers 52, 54 accordingly.

The sub-field read process 90 receives address information from the video data addressing process 70 and sequentially reads pixel data from the sub-field 0 frame buffer 52. Typically, the address information from the video data address process 70 to the sub-field read process 90 is incremented in a manner so that the pixel data read from the frame buffers form horizontal scan lines extending from left to right and advancing down the frame. The sub-field read process 90 provides the sub-field 0 video data to the output communication process 74. The output communication process 74 provides the sub-field 0 video data to the post-processing module 16.

Once the sub-field read process 90 has processed all the video data associated with the sub-field 0 frame buffer 52 and at an appropriate time interval (i.e., sub-field repetition rate), the video data address process 70 directs the sub-field read process 90 to read video data from the next sub-field frame buffer (e.g., sub-field 1 frame buffer). The second transpose processor 22 processes video data from the next sub-field frame buffer as described above for sub-field 0 and continues processing each sequential sub-field in the same manner until the sub-field N frame buffer 54 is processed. Once the sub-field N frame buffer 54 is processed, the frame repetition cycle is complete and the second transpose processor 22 is ready to process the next frame beginning with sub-field 0. As described above, the transposed sub-field video data provided by the second transpose processor 22 is compatible with monochrome DMDs.

The sub-field sequencing process 88 also operates as described above in conjunction with the RGB sub-field read process. The video data addressing process 70 receives RGB sub-field information from the sub-field sequencing process 88 and controls address pointers associated with the RGB sub-field 0 through RGB sub-field N frame buffers 53, 55 accordingly.

The RGB sub-field read process 91 receives address information from the video data addressing process 70 and sequentially reads pixel data from the RGB sub-field frame buffer 53. Typically, the address information from the video data address process 70 to the RGB sub-field read process 91 is incremented in a manner so that the pixel data read from the frame buffers form horizontal scan lines extending from left to right and advancing down the frame. The RGB sub-field read process 91 provides the RGB sub-field 0 video data to the output communication process 74. The output communication process 74 provides the sub-field 0 video data to the post-processing module 16.

Once the RGB sub-field read process 91 has processed all the video data associated with the RGB sub-field 0 frame buffer 53 and at an appropriate time interval (i.e., sub-field repetition rate), the video data address process 70 directs the RGB sub-field read process 91 to read video data from the next RGB sub-field frame buffer (e.g., RGB sub-field 1 frame buffer). The second transpose processor 22 processes video data from the next RGB sub-field frame buffer as described above for RGB sub-field 0 and continues processing each sequential RGB sub-field in the same manner until the RGB sub-field N frame buffer 55 is processed. Once the RGB sub-field N frame buffer 55 is processed, the frame repetition cycle is complete and the second transpose processor 22 is ready to process the next frame beginning with RGB sub-field 0. As described above, the transposed RGB sub-field video data provided by the second transpose processor 22 is compatible with PDPs.

The configuration identification process 92 in the second transpose processor 22 facilitates use of the re-ordering apparatus 14 in various dedicated display processing systems 10. For example, when a display processing system 10 is manufactured for a dedicated display device, the configuration identification process 92 can be used to tailor the active processes within the second transpose processor 18 to those associated with the dedicated display device. Thus, the generic processes associated with the second transpose processor 18 can be activated or deactivated to increase processing efficiency.

Figure 10:
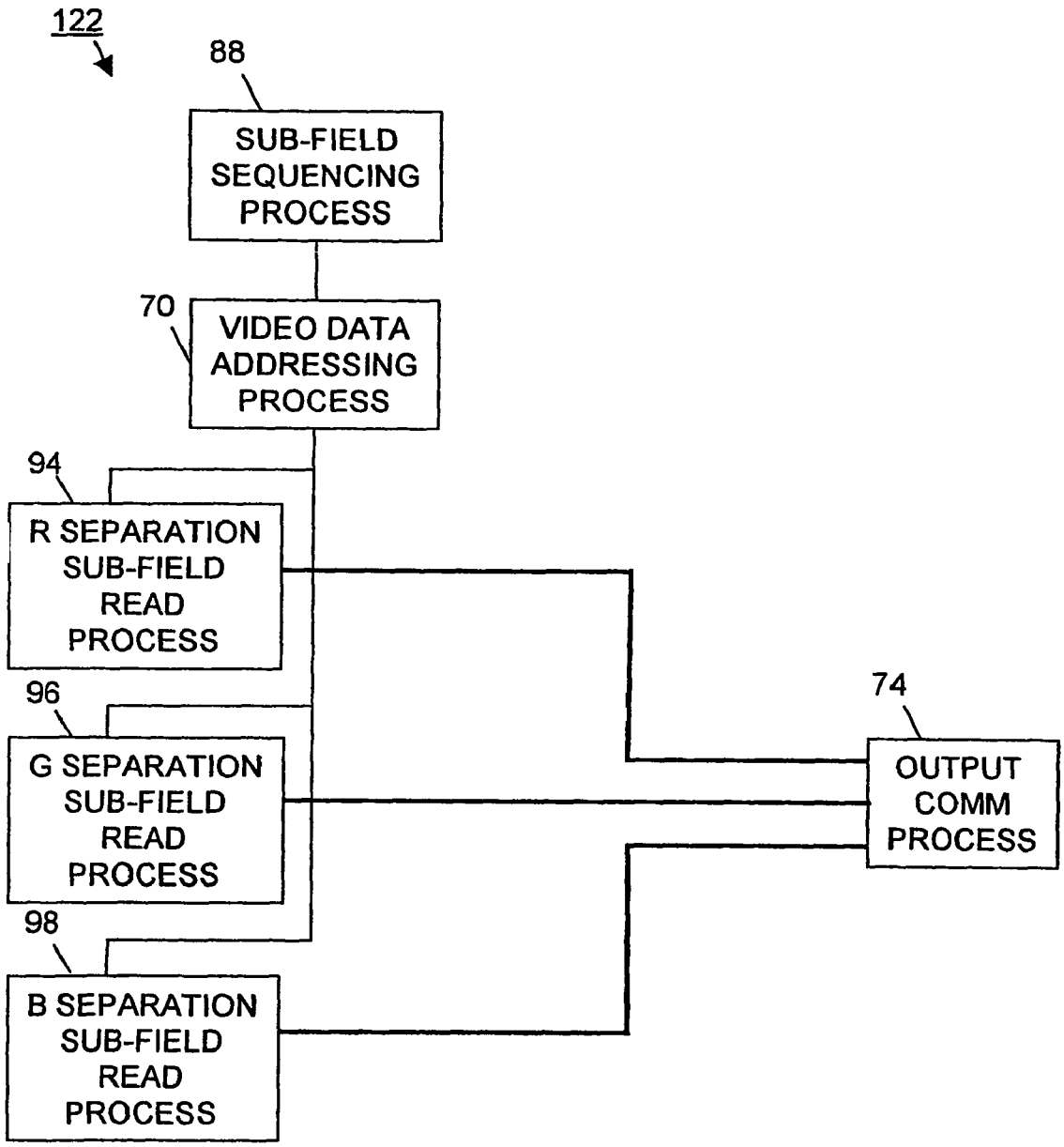
FIG. 10 is a block diagram of another exemplary embodiment of the second transpose processor of the re-ordering apparatus.

With reference to FIG. 10, another exemplary embodiment of the second transpose processor 122 includes the sub-field sequencing process 88, the video data addressing process 70, an R separation sub-field read process 94, a G separation sub-field read process 96, a B separation sub-field read process 98, and an output communication process 74. Another embodiment of the second transpose processor includes the processes of FIG. 10 and the processes of the second transpose process 22 of FIG. 8.

In the embodiment being described, the video data addressing process 70 is as described above for the second transpose processor 22 of FIG. 8. The sub-field sequencing process 88 includes a one or more values associated with the number of R, G, and B separation sub-fields generated, a sequence for reading the R, G, and B separation sub-fields, and a value associated with the amount of time each sub-field is to be displayed. The sub-field sequencing process 88 is in communication with the video data addressing process 70. The video data addressing process 70 receives R separation sub-field information from the sub-field sequencing process 88 and controls an address pointer associated with the R separation sub-field 0 through sub-field N frame buffers 58, 60, accordingly. Likewise, the video data addressing process 70 receives G separation sub-field information and controls an address pointer associated with the G separation sub-field 0 through sub-field N frame buffers 62, 64. Additionally, the video data addressing process 70 receives B separation sub-field information and controls an address pointer associated with the B separation sub-field 0 through sub-field N frame buffers 66, 68.

The R separation sub-field read process 94 receives address information from the video data addressing process 70 and sequentially reads pixel data from the R separation sub-field 0 frame buffer 58. Typically, the address information from the video data address process 70 to the R separation sub-field read process 94 is incremented in a manner so that the pixel data read from the frame buffers form horizontal scan lines extending from left to right and advancing down the frame. The R separation sub-field read process 94 provides the sub-field 0 video data to the output communication process 74. The output communication process 74 provides the sub-field 0 video data to the post-processing module 16.

Once the R separation sub-field read process 94 has processed all the video data associated with the R separation sub-field 0 frame buffer 58 and at an appropriate time interval (i.e., sub-field repetition rate), the video data address process 70 directs the R separation sub-field read process 94 to read video data from the next R separation sub-field frame buffer (e.g., R separation sub-field 1 frame buffer). The second transpose processor 122 processes video data from the next R separation sub-field frame buffer as described above for R separation sub-field 0 and continues processing each sequential R separation sub-field in the same manner until the R separation sub-field N frame buffer 60 is processed.

The second transpose processor 122 reads video data from the G separation sub-field frame buffers 62, 64 using the G separation sub-field read process 96 and processes the G separation sub-field video data in the same manner as described above for the R separation sub-field. Likewise, the second transpose processor 122 reads video data from the B separation sub-field frame buffers 66, 68 using the B separation sub-field read process 98 and processes the B separation sub-field video data in the same manner. The second transpose processor 122 processes the G and B separation sub-field data substantially in parallel with the R separation sub-field data for a given frame with respect to sub-field timing and frame repetition cycles.

Once the R, G, and B separation sub-field N frame buffers 60, 64, 68 are processed, the frame repetition cycle is complete and the second transpose processor 122 is ready to process the next frame beginning with R, G, and B separation sub-field 0. As described above, the transposed R, G, and B sub-field video data provided by the second transpose processor 122 is compatible with color DMDs.

While the invention is described herein in conjunction with exemplary embodiments, it is evident that many alternatives, modifications, and variations will be apparent to those skilled in the art. Accordingly, the embodiments of the invention in the preceding description are intended to be illustrative, rather than limiting, of the spirit and scope of the invention. More specifically, it is intended that the invention embrace all alternatives, modifications, and variations of the exemplary embodiments described herein that fall within the spirit and scope of the appended claims or the equivalents thereof.

Having described the preferred embodiments, the invention is now claimed to be:

1. An apparatus for re-ordering video data for a display, comprising:

a) a first transpose means for receiving video data and performing a first transpose process on such video data to create partially re-ordered video data;

b) a means for storing the partially re-ordered video data; and c) a second transpose means for reading the partially re-ordered video data and performing a second transpose process on such partially re-ordered video data to create fully re-ordered video data, wherein the first and second transpose means are configured to perform the first and second transpose processes to convert the received video data to the fully re-ordered video data that is a transposed video data of the received video data, the fully re-ordered video data being compatible to a transposed scanning technique for driving the display, wherein the first transpose means includes means for receiving RGB video data and writing at least one frame of the RGB video data to the storing means, and means for separating the RGB video data into separate R, G, and B separation video data and writing at least one frame of the separation video data, at least one frame of the G separation video data, and at least one frame of the B separation video data to the storing means, and wherein the second transpose means includes:

a means for addressing the RGB video data stored in the storing means;

a means for reading the RGB video data stored in the storing means to created fully re-ordered RGB video data;

a means for communicating the fully re-ordered RGB video data to downstream modules of a display processing system;

a means for addressing the R, G, and B separation video data stored in the storing means;

a means for reading the R, G, and B separation video data stored in the storing means;

a means for re-ordering the R, G, and B separation video data into fully re-ordered R, G, and B color bar video data having consecutive downwardly scrolling R, G, and B scan lines; and a means for communicating the fully re-ordered R, G, and B color bar video data to the downstream modules of the display processing system.

2. The apparatus as set forth in claim 1 wherein the first and second transpose means include:

one or more programmable hardware blocks.

3. The apparatus as set forth in claim 1 wherein:

the first transpose means includes a first programmable processor and the second transpose means includes a second programmable processor, such that the apparatus is programmable for any of a plurality of display formats.

4. The apparatus as set forth in claim 3 wherein the first and second processors are fabricated on a common substrate (S).

5. The apparatus as set forth in claim 4 wherein the storing means includes computer memory which is fabricated on the common substrate.

6. The apparatus as set forth in claim 4 wherein the storing means includes a separate IC that is electrically connected with the first and second programmable processors.

7. The apparatus as set forth in claim 3 wherein the first and second processors are programmable to re-order video data for two or more types of displays selected from the group consisting of a transpose scan CRT display, an LCOS device, a PDP, a monochrome DMD, and a color DMD.

8. The apparatus as set forth in claim 1, the storing means including:

a means for storing at least two consecutive frames of the partially re-ordered video data.

9. The apparatus as set forth in claim 8 wherein the second transpose means includes a processor programmed to read the partially re-ordered video data associated with a first frame from the storing means while the first transpose means writes the partially re-ordered video data associated with a second frame to the storing means.

10. The apparatus as set forth in claim 1, the reading means including:

a means for identifying an operational configuration for the receiving means based on a selected display.

11. The apparatus as set forth in claim 1, the receiving means including: a means for generating a plurality of sub-fields associated with a frame of the received video data, wherein each sub-field includes sub-field video data associated with the received video data; and a means for writing the sub-field video data for the plurality of sub-fields to the storing means.

12. The apparatus as set forth in claim 11, the generating means including:

a means for temporarily storing a predetermined amount of sub-field data that is generated serially, wherein the writing means transfers the predetermined amount of sub-field data from the temporary storing means to the storing means in parallel.

13. The apparatus as set forth in claim 11, the storing means including:

a means for storing the sub-field video data for the plurality of sub-fields.

14. The apparatus as set forth in claim 13, the reading means including:

a means for addressing the sub-field video data for the plurality of sub-fields in the storing means;

a means for reading the sub-field video data for the plurality of sub-fields in the storing means to create a fully re-ordered sub-field video data; and a means for communicating the fully re-ordered sub-field video data to downstream modules of a display processing system.

15. The apparatus as set forth in claim 11 wherein the sub-fields are RGB sub-fields and the sub-field data is RGB sub-field data.

16. The apparatus as set forth in claim 11, the generating means including:

a means for temporarily storing a predetermined amount of RGB sub-field data that is generated serially, wherein the writing means transfers the predetermined amount of RGB sub-field data from the temporary storing means to the storing means in parallel.

17. The apparatus as set forth in claim 15, the storing means including:

a means for storing the RGB sub-field video data for the plurality of RGB subfields.

18. The apparatus as set forth in claim 17, the reading means including:

a means for addressing the RGB sub-field video data for the plurality of RGB sub-fields in the storing means;

a means for reading the RGB sub-field video data for the plurality of RGB sub-fields in the storing means to create a fully re-ordered RGB sub-field video data; and a means for communicating the fully re-ordered RGB sub-field video data to downstream modules of a display processing system.

19. The apparatus as set forth in claim 1, the receiving means including: a means for generating a plurality of R separation sub-fields associated with a frame of the R separation video data, wherein each R separation sub-field includes R separation sub-field video data associated with the R separation video data; a means for generating a plurality of G separation sub-fields associated with a frame of the G separation video data, wherein each G separation sub-field includes G separation sub-field video data associated with the G separation video data; a means for generating a plurality of B separation sub-fields associated with a frame of the B separation video data, wherein each B separation sub-field includes B separation sub-field video data associated with the B separation video data; and a means for writing the R separation sub-field video data for the plurality of R separation sub-fields, the G separation sub-field video data for the plurality of G separation sub-fields, and the B separation sub-field video data for the plurality of B separation sub-fields to the storing means.

20. The apparatus as set forth in claim 19, the storing means including:

a means for storing the R separation sub-field video data for the plurality of R separation sub-fields;

a means for storing the G separation sub-field video data for the plurality of G separation sub-fields; and a means for storing the B separation sub-field video data for the plurality of B separation sub-fields.

21. The apparatus as set forth in claim 20, the reading means including:

a means for addressing the R separation sub-field video data for the plurality of R separation sub-fields in the storing means;

a means for reading the R separation sub-field video data for the plurality of R separation sub-fields in the storing means to create fully re-ordered R separation sub-field video data;

a means for communicating the fully re-ordered R separation sub-field video data to downstream modules of a display processing system;

a means for addressing the G separation sub-field video data for the plurality of G separation sub-fields in the storing means;

a means for reading the G separation sub-field video data for the plurality of G separation sub-fields in the storing means to create fully re-ordered G separation sub-field video data;

a means for communicating the fully re-ordered G separation sub-field video data to downstream modules of a display processing system;

a means for addressing the B separation sub-field video data for the plurality of B separation sub-fields in the storing means;

a means for reading the B separation sub-field video data for the plurality of B separation sub-fields in the storing means to create fully re-ordered B separation sub-field video data; and a means for communicating the fully re-ordered B separation sub-field video data to downstream modules of a display processing system.

22. The apparatus as set forth in claim 1, the receiving means including: a means for identifying an operational configuration for the receiving means based on a selected display.

23. An integrated circuit for re-ordering video data to a selected display format, the integrated circuit comprising:

a substrate;

a first programmable processor fabricated on the substrate and connected with video input and programming terminals, the first programmable processor being configured to perform a first transpose process on the video data to create partially transposed video data;

a second programmable processor fabricated on the substrate and connected with video output and programming terminals, the second programmable processor being configured to perform a second transpose process on the partially transposed video data to create frilly transposed video of the video data; and a memory electrically connected with the first and second processors to have data written into the memory from the first processor and read out of the memory by the second processor, wherein the fully transposed video data is compatible to a transposed scanning technique for driving the display, wherein first programmable processor includes means for receiving RGB video data and writing at least one frame of the RGB video data to the memory, and means for separating the RGB video data into separate R, G, and B separation video data and writing at least one frame of the separation video data, at least one frame of the G separation video data, and at least one frame of the B separation video data to the memory, and wherein the second programmable processor includes:

a means for addressing the RGB video data stored in the memory;

a means for reading the RGB video data stored in the memory to created fully re-ordered RGB video data;

a means for communicating the fully re-ordered RGB video data to downstream modules of a display processing system;

a means for addressing the R, G, and B separation video data stored in the memory;

a means for reading the R, G, and B separation video data stored in the memory;

a means for re-ordering the R, G, and B separation video data into fully re-ordered R, G, and B color bar video data having consecutive downwardly scrolling R, G, and B scan lines; and a means for communicating the fully re-ordered R, G, and B color bar video data to the downstream modules of the display processing system.

24. The integrated circuit as set forth in claim 23 wherein the memory is fabricated on the substrate.

25. A method of converting video data from a first format to a second format comprising:

programming a first processor with a first transform which transforms the first format video data to an intermediate format data for storage in a memory; and programming a second processor with a second transform which transforms the intermediate format data from the memory into the second video format, wherein the second format video data is a transposed video data of the first format video data, the second format video data being compatible to a transposed scanning technique for driving the display, and wherein the method further comprises:

receiving RGB video data:

writing at least one frame of the RGB video data to the memory;

separating the RGB video data into separate R, G, and B separation video data;

writing at least one frame of the separation video data, at least one frame of the G separation video data, and at least one frame of the B separation video data to the memory;

addressing the RGB video data stored in the memory;

reading the RGB video data stored in the memory to created fully re-ordered RGB video data;

communicating the frilly re-ordered RGB video data to downstream modules of a display processing system;

addressing the R, G, and B separation video data stored in the memory;

reading the R, G, and B separation video data stored in the memory;

re-ordering the R, G, and B separation video data into fully re-ordered R, G, and B color bar video data having consecutive downwardly scrolling R, G, and B scan lines; and communicating the fully re-ordered R, G, and B color bar video data to the downstream modules of the display processing system.

26. The method as set forth in claim 25 further including:

supplying the first format video data to the first processor;

transforming the supplied first format video data to the intermediate format data with the first processor;

writing the intermediate format data to the memory;

reading the intermediate format data from the memory with the second processor; and transforming the intermediate format data to the second format video data.

27. The method as set forth in claim 25 further including:

fabricating the first and second processors and the memory on a common substrate.

* * * * *